US006209611B1

(12) United States Patent
Johnson

(10) Patent No.: US 6,209,611 B1
(45) Date of Patent: Apr. 3, 2001

(54) COLLAPSIBLE COVER APPARATUS

(76) Inventor: Wayne Johnson, 264 E. Pastime #9, Tucson, AZ (US) 85705

( * ) Notice: Subject to any disclaimer, the term of this patent is extended or adjusted under 35 U.S.C. 154(b) by 0 days.

(21) Appl. No.: 09/497,901

(22) Filed: Feb. 4, 2000

(51) Int. Cl.[7] ..... A47H 5/00

(52) U.S. Cl. ..... 160/84.01; 160/132; 135/88.03; 135/90; 297/184.11; 297/184.17

(58) Field of Search ..... 160/84.01, 132, 160/135, 137, 160; 135/88.01, 88.02, 88.03, 88.04, 90; 297/184.11, 184.17, DIG. 4; 296/78.1

(56) References Cited

U.S. PATENT DOCUMENTS

D. 319,202 * 8/1991 Reinhart ..... D12/133
4,275,921 * 6/1981 Genin ..... 160/132 X
4,389,057 * 6/1983 Richard, Jr. ..... 135/90 X
4,533,170 * 8/1985 Banks et al. ..... 296/78.1
4,630,545 * 12/1986 Michel ..... 160/132 X
4,643,479 * 2/1987 Servi ..... 297/184
4,754,987 * 7/1988 Williams ..... 296/78.1 X
4,949,740 * 8/1990 Friday ..... 135/90
5,168,889 * 12/1992 Diestel ..... 135/88
5,921,258 * 7/1999 Francois ..... 135/88.03

* cited by examiner

*Primary Examiner*—Daniel P. Stodola
*Assistant Examiner*—Bruce A. Lev

(57) ABSTRACT

A collapsible cover apparatus for mounting to a wheel chair to protect the occupant of the wheel chair from the weather. The collapsible cover apparatus includes a pair of frame support bars. Each of the frame support bars is elongate and each of the frame support bars is releasably couplable to a wheel chair. A plurality of brackets are slidably mounted in the frame support bars. A plurality of covering support bars support the covering. Each of the covering support bars generally has a U-shape which includes a base portion, a first leg portion and a second leg portion. Each of the leg portions has a free end that is fixedly coupled to one of the brackets. A fastener fastens the cover member to the frame. The fastener is fixedly coupled to an inside surface of the panels and fixedly coupled to each of the covering support bars.

10 Claims, 3 Drawing Sheets

FIG. 3
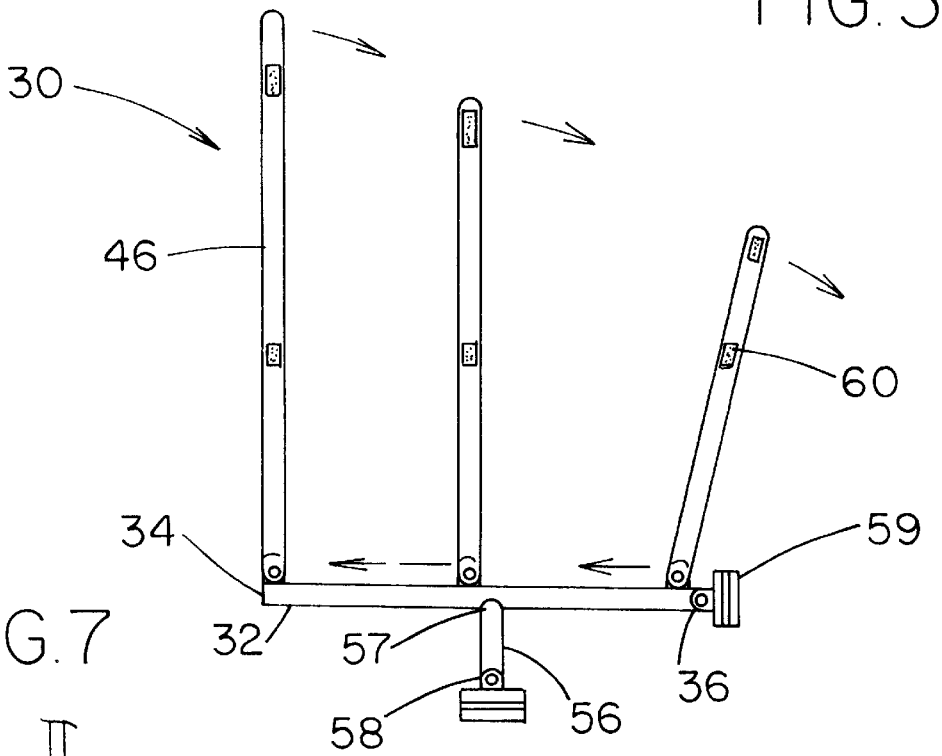
FIG. 7
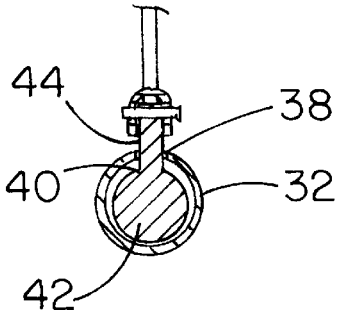
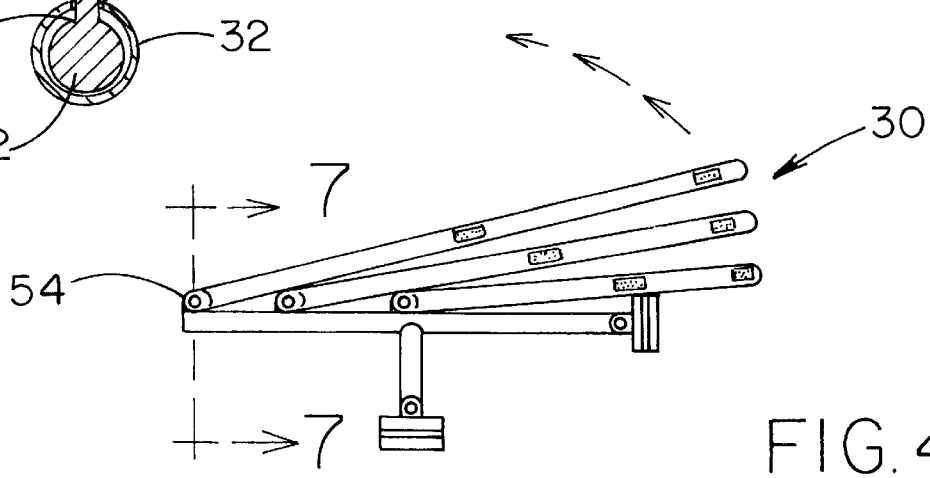
FIG. 4

COLLAPSIBLE COVER APPARATUS

BACKGROUND OF THE INVENTION

1. Field of the Invention

The present invention relates to coverings and more particularly pertains to a new collapsible cover apparatus for mounting to a wheel chair to protect the occupant of the wheel chair from the weather.

2. Description of the Prior Art

The use of coverings is known in the prior art. More specifically, coverings heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,754,987; U.S. Pat. No. 4,949,740; U.S. Pat. No. 4,533,170; U.S. Pat. No. 4,643,479; U.S. Pat. No. 4,389,057; and U.S. Des. Patent No. 319,202.

While these devices fulfill their respective, particular objectives and requirements, the aforementioned patents do not disclose a new collapsible cover apparatus. The inventive device includes a covering member. The covering member comprises a plurality of panels integrally coupled to each other. A frame includes a pair of frame support bars. Each of the frame support bars is elongate and each of the frame support bars is releasably couplable to a wheel chair. A plurality of brackets are slidably mounted in the frame support bars. A plurality of covering support bars support the covering. Each of the covering support bars generally has a U-shape which includes a base portion, a first leg portion and a second leg portion. Each of the leg portions has a free end that is fixedly coupled to one of the brackets. A fastening means fastens the cover member to the frame. The fastening means is fixedly coupled to an inside surface of the panels and fixedly coupled to each of the covering support bars.

In these respects, the collapsible cover apparatus according to the present invention substantially departs from the conventional concepts and designs of the prior art, and in so doing provides an apparatus primarily developed for the purpose of mounting to a wheel chair to protect the occupant of the wheel chair from the weather.

SUMMARY OF THE INVENTION

In view of the foregoing disadvantages inherent in the known types of coverings now present in the prior art, the present invention provides a new collapsible cover apparatus construction wherein the same can be utilized for mounting to a wheel chair to protect the occupant of the wheel chair from the weather.

The general purpose of the present invention, which will be described subsequently in greater detail, is to provide a new collapsible cover apparatus apparatus and method which has many of the advantages of the coverings mentioned heretofore and many novel features that result in a new collapsible cover apparatus which is not anticipated, rendered obvious, suggested, or even implied by any of the prior art coverings, either alone or in any combination thereof.

To attain this, the present invention generally comprises G a covering member. The covering member comprises a plurality of panels integrally coupled to each other. A frame includes a pair of frame support bars. Each of the frame support bars is elongate and each of the frame support bars is releasably couplable to a wheel chair. A plurality of brackets are slidably mounted in the frame support bars. A plurality of covering support bars support the covering. Each of the covering support bars generally has a U-shape which includes a base portion, a first leg portion and a second leg portion. Each of the leg portions has a free end that is fixedly coupled to one of the brackets. A fastening means fastens the cover member to the frame. The fastening means is fixedly coupled to an inside surface of the panels and fixedly coupled to each of the covering support bars.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new collapsible cover apparatus apparatus and method which has many of the advantages of the coverings mentioned heretofore and many novel features that result in a new collapsible cover apparatus which is not anticipated, rendered obvious, suggested, or even implied by any of the prior art coverings, either alone or in any combination thereof.

It is another object of the present invention to provide a new collapsible cover apparatus which may be easily and efficiently manufactured and marketed.

It is a further object of the present invention to provide a new collapsible cover apparatus which is of a durable and reliable construction.

An even further object of the present invention is to provide a new collapsible cover apparatus which is susceptible of a low cost of manufacture with regard to both materials and labor, and which accordingly is then susceptible of low prices of sale to the consuming public, thereby making such collapsible cover apparatus economically available to the buying public.

Still yet another object of the present invention is to provide a new collapsible cover apparatus which provides in the apparatuses and methods of the prior art some of the advantages thereof, while simultaneously overcoming some of the disadvantages normally associated therewith.

Still another object of the present invention is to provide a new collapsible cover apparatus for mounting to a wheel chair to protect the occupant of the wheel chair from the weather.

Yet another object of the present invention is to provide a new collapsible cover apparatus which includes a pair of frame support bars. Each of the frame support bars is elongate and each of the frame support bars is releasably couplable to a wheel chair. A plurality of brackets are slidably mounted in the frame support bars. A plurality of covering support bars support the covering. Each of the covering support bars generally has a U-shape which includes a base portion, a first leg portion and a second leg portion. Each of the leg portions has a free end that is fixedly coupled to one of the brackets. A fastening means fastens the cover member to the frame. The fastening means is fixedly coupled to an inside surface of the panels and fixedly coupled to each of the covering support bars.

Still yet another object of the present invention is to provide a new collapsible cover apparatus that mounts on a wheel chair and has a covering which may be removed from the frame.

Even still another object of the present invention is to provide a new collapsible cover apparatus that has a frame which has cover member support bars which slide between a collapsed position and erected position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic side view of the frame of the present invention.

FIG. 4 is a schematic side view of the frame in a collapsed position of the present invention.

FIG. 7 is a schematic cross-sectional view taken along line 7—7 of the present invention.

DESCRIPTION OF THE PREFERRED EMBODIMENT

Figure 1:
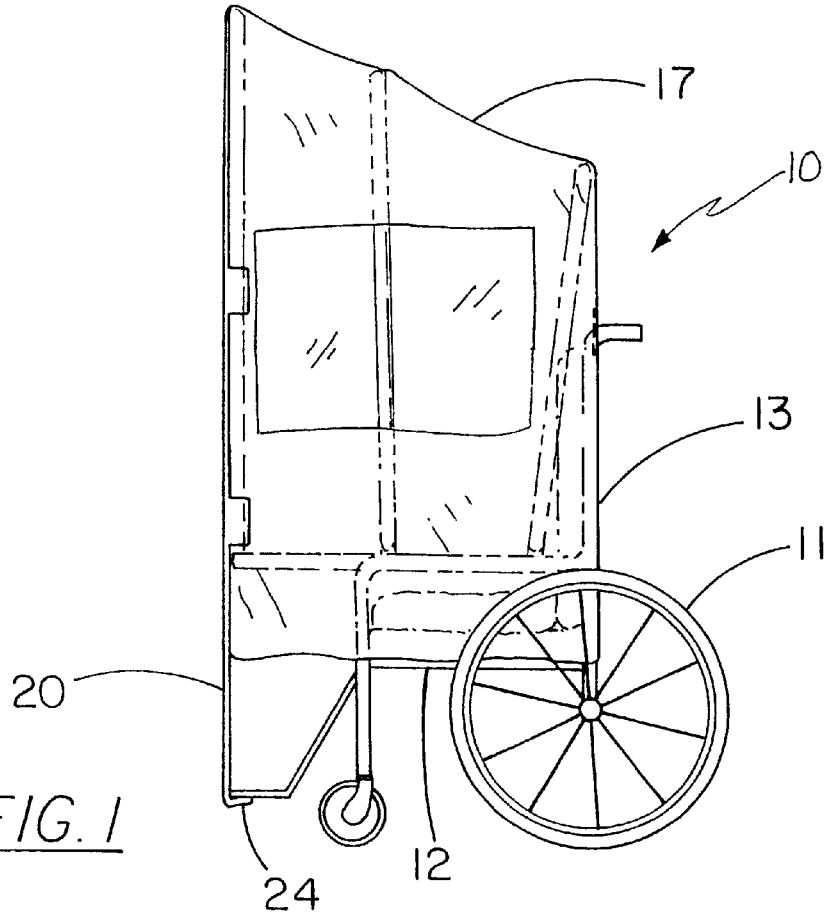
FIG. 1 is a schematic side view of a new collapsible cover apparatus according to the present invention.
Figure 2:
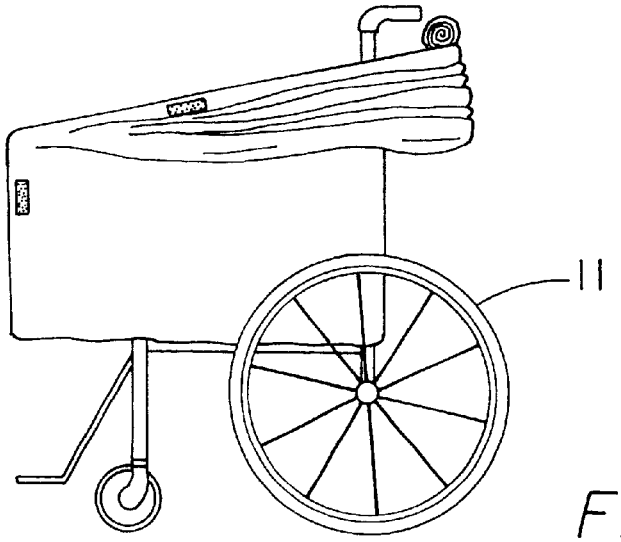
FIG. 2 is a schematic side view of the present invention.
Figure 5:
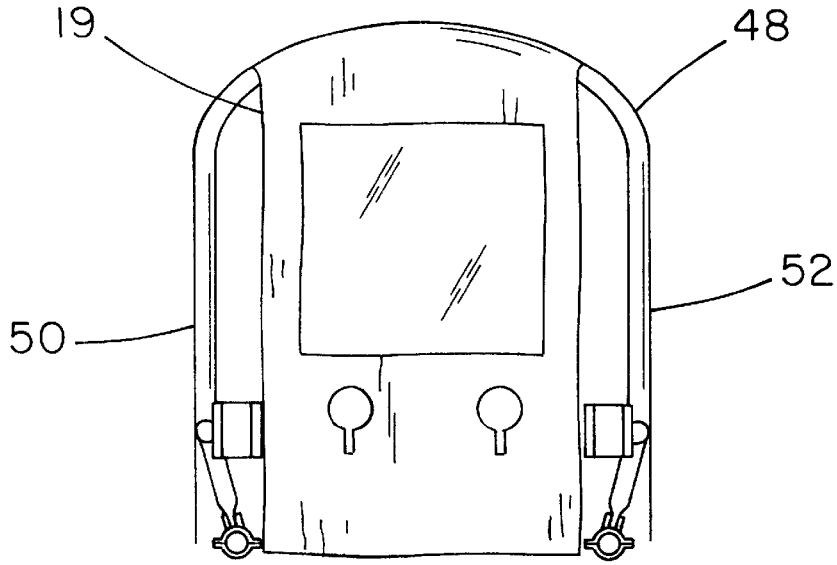
FIG. 5 is a schematic back view of the present invention.

With reference now to the drawings, and in particular to FIGS. 1 through 7 thereof, a new collapsible cover apparatus embodying the principles and concepts of the present invention and generally designated by the reference numeral 10 will be described.

As best illustrated in FIGS. 1 through 7, the collapsible cover apparatus 10 generally comprises an apparatus that is removably mountable to a wheel chair 11. The wheel chair 11 has a pair of generally horizontal seat support bars 12 and a pair of generally vertical back rest 13 support bars.

Figure 6:
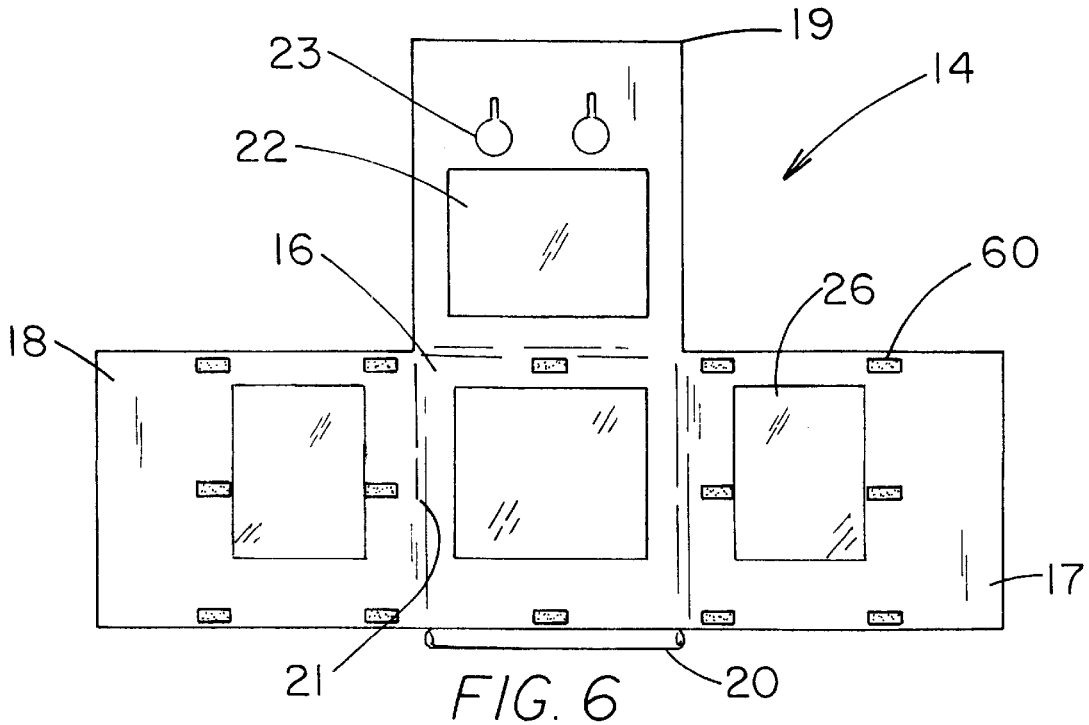
FIG. 6 is a schematic plan view of the covering member of the present invention.

The apparatus has covering member 14. The covering member contains a plurality of panels. A first 16 of the panels has four edges 21. A second panel 17, a third panel 18, fourth panel 19 and a fifth panel 20 each has an edge integrally coupled to one of the edges 21 of the first panel 16. The first 16, second 17 and third 18 panels generally lie along a straight line and the first 16, fourth 19 and fifth 20 panels generally lie along a straight line when the panels lie in a plane as shown in FIG. 6. Each of the panels is generally flexible. Each of the panels has a generally rectangular shape. The panels each have an opening 22 therein. The fourth panel 19 has a pair of apertures 23 therein for receiving the handles of the wheel chair. The apertures 23 are positioned between the opening 22 in the fourth panel 19 and an edge of the fourth panel opposed to the first panel. The fifth panel 20 generally has a length twice as long as the fourth panel 19 and a free edge 24 adapted to releasably couple to the foot rest of the wheel chair 11. FIG. 6 depicts the fifth panel 20 in a rolled-up position.

A plurality of shields 26 covers the openings 22 in the panels and act as window. Each of the shields 26 is fixedly coupled to one of the panels. The shields 26 are preferably flexible and transparent. Each of the shields ideally comprises an elastomeric material or a plastic.

A frame 30 includes a pair of frame support bars 32. Each of the frame support bars 32 is elongate having a first end 34 and a second end 36. Each of the frame support bars 30 has a slot 38 therein. The slot 38 extends between the first 34 and second 36 ends of the frame support bars 32.

A plurality of brackets 40 each has a base portion 42 and a protruding member 44. Each of the base portions 42 is slidably mounted in the slots 38 of the frame support bars 32. Preferably three of the brackets 40 are mounted in each of the frame support bars. Each of the protruding members 44 extends away from the frame support bars 32.

A plurality of covering support bars 46 support the covering member 14. Each of the covering support bars 46 generally has a U-shape. Each of the support bars 46 has a base portion 48, a first leg portion 50 and a second leg portion 52. Each of the leg portions has a free end 54. The base portions 48 are bowed away from the free ends 54 of the leg portions. The free ends 54 of the first leg portion 50 are hingedly coupled to one of the protruding members 44 slidably mounted in a first of the frame support bars 32. The free ends 54 of the second leg portions 52 are hingedly coupled to one of the protruding members 44 slidably mounted in a second of the frame support bars 32.

A securing means releasably secures the frame support bars to the wheel chair 11. The securing means comprises a pair of elongate members 56. Each of the elongate members 56 has a first end 57 and a second end 58. Each of the first ends 57 of the elongate members 56 is fixedly coupled to one of the frame support members 32, and each of the elongate members 56 is generally located in a central portion of the frame support members 32. The elongate members generally extend in an opposite direction of the protruding members 44. Each of the second ends 58 of the elongate members is releasably secured to one of the seat support bars 12 of the wheel chair 11 using conventional clamps.

Each of a pair of clamping means 59 is fixedly coupled to one of the second ends 36 of the frame support bars 32. The clamping means 59 are releasably coupled to one of the back rest support bars 13 of the wheel chair 11. The clamping means 59 are conventional clamps.

A fastening means fastens 60 the cover member 14 to the frame 30. The fastening means 60 is fixedly coupled to an inside surface of the first 16, second 17 and third 18 panels. The fastening means 60 is fixedly coupled to each of the covering support bars 46. The fastening means 60 is generally located on the covering support bars 46 such that the fastening means 60 on the cover member 14 is aligned with the fastening means on the covering support bars. Ideally, the fastening means 60 is a hook and loop fastening means.

In use, the frame is mounted on the wheel chair. In bad weather, the covering supports are placed in a vertical position and the covering member is placed on the covering supports. The windows in the covering member allow the occupant of the wheel chair to still be able to see while being protected from wind and precipitation.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible cover apparatus, said apparatus being removably mountable to a wheel chair, the wheel chair having a pair of generally horizontal seat support bars and a pair of generally vertical back rest support bars, said apparatus comprising:

a covering member, said covering member comprising:

a plurality of panels integrally coupled to each other;

a frame, said frame comprising:

a pair of frame support bars, each of said frame support bars being elongate, each of said frame support bars being releasably couplable to the wheel chair;

a plurality of brackets, each of said being slidably mounted in said frame support bars;

a plurality of covering support bars for supporting said covering, each of said covering support bars generally having a U-shape, each of said support bars having a base portion, a first leg portion and a second leg portion, each of said leg portions having a free end being fixedly coupled to one of said brackets; and a fastening means for fastening said cover member to said frame, said fastening means being fixedly coupled to an inside surface of said panels and fixedly coupled to each of said covering support bars.

2. The collapsible cover apparatus as in claim 1, wherein said covering member comprises:

a first of said panels having four edges, a second panel, a third panel, fourth panel and a fifth panel each having an edge integrally coupled to one of said edges of said first panel, said first, second and third panels generally lying along a straight line and said first, fourth and fifth panels generally lying along a straight line when said panels lie in a plane, each of said panels being generally flexible, each of said panels having a generally rectangular shape, each of said panels having an opening therein.

3. The collapsible cover apparatus as in claim 2, wherein said panels comprise:

said fourth panel having a pair of apertures therein, said apertures being positioned between said opening in said fourth panel and an edge of said fourth panel opposed to said first panel, said fifth panel generally having a length twice as long as said fourth panel, said fifth panel having a free edge adapted to releasably couple to the foot rest of the wheel chair.

4. The collapsible cover apparatus as in claim 2, said covering member further comprising:

a plurality of shields for covering said openings in said panels, each of said shields being fixedly coupled to one of said panels, each of said shields covering one of said openings in said panels, each of said shields being flexible, each of said shields being transparent.

5. The collapsible cover apparatus as in claim 2, wherein said frame comprises:

each of said frame support bars having a first end, and a second end, each of said frame support bars having a slot therein, said slot extending between said first and second ends of said frame support bars; and each of said brackets having a base portion and a protruding member, each of said base portions being slidably mounted in said slots of said frame support bars, wherein three of said brackets are mounted in each of said frame support bars, each of said protruding members extending away from said frame support bars, said covering support bars being hingedly coupled to said protruding members.

6. The collapsible cover apparatus as in claim 5, wherein said frame comprises:

said base portions being bowed away from said free ends of said leg portions, each of said free ends of said first leg portions being hingedly coupled to one of said protruding members slidably mounted in a first of said frame support bars, each of a said free ends of said second leg portions being hingedly coupled to one of said protruding members slidably mounted in a second of said frame support bars.

7. The collapsible cover apparatus as in claim 5, further comprising:

a securing means for releasably securing said frame support bars to the wheel chair, said securing means comprising:

a pair of elongate members, each of said elongate members having a first end and a second end, each of said first ends of said elongate members being fixedly coupled to one of said frame support members, each of said elongate members being generally located in a central portion of said frame support members, said elongate members generally extending in an opposite direction of said protruding members, each of said second ends of said elongate members being adapted for releasably securing to one of the seat support bars of the wheel chair.

8. The collapsible cover apparatus as in claim 7, said securing means further comprising:

a pair of clamping means, each of said clamping means being fixedly coupled to one of said second ends of said frame support bars, each of said clamping means being adapted for releasably coupling to one of the back rest support bars of the wheel chair.

9. The collapsible cover apparatus as in claim 6, wherein said fastening means comprises:

Said fastening means being fixedly coupled to an inside surface of said first, second and third panels, said fastening means being fixedly coupled to each of said covering support bars, said fastening means being generally located on said covering support bars such that said fastening means on said cover member is aligned with said fastening means on said covering support bars, said fastening means being a hook and loop fastening means.

10. A collapsible cover apparatus, said apparatus being removably mountable to a wheel chair, the wheel chair having a pair of generally horizontal seat support bars and a pair of generally vertical back rest support bars, said apparatus comprising:

a covering member, said covering member comprising:

a plurality of panels, a first of said panels having four edges, a second panel, a third panel, fourth panel and a fifth panel each having an edge integrally coupled to one of said edges of said first panel, said first, second and third panels generally lying along a straight line and said first, fourth and fifth panels generally lying along a straight line when said panels lie in a plane, each of said panels being generally flexible, each of said panels having a generally rectangular shape, each of said panels having an opening therein, said fourth panel having a pair of apertures therein, said apertures being positioned between said opening in said fourth panel and an edge of said fourth panel opposed to said first panel, said fifth panel generally having a length twice as long as said fourth panel, said fifth panel having a free edge adapted to releasably couple to the foot rest of the wheel chair;

a plurality of shields for covering said openings in said panels, each of said shields being fixedly coupled to one of said panels, each of said shields covering one of said openings in said panels, each of said shields being flexible, each of said shields being transparent, each of said shields comprising an elastomeric material;

a frame, said frame comprising:

a pair of frame support bars, each of said frame support bars being elongate and having a first end, and a second end, each of said frame support bars having a slot therein, said slot extending between said first and second ends of said frame support bars;

a plurality of brackets, each of said brackets having a base portion and a protruding member, each of said base portions being slidably mounted in said slots of said frame support bars, wherein three of said brackets are mounted in each of said frame support bars, each of said protruding members extending away from said frame support bars;

a plurality of covering support bars for supporting said covering, each of said covering support bars generally having a U-shape, each of said support bars having a base portion, a first leg portion and a second leg portion, each of said leg portions having a free end, said base portions being bowed away from said free ends of said leg portions, each of said free ends of said first leg portions being hingedly coupled to one of said protruding members slidably mounted in a first of said frame support bars, each of a said free ends of said second leg portions being hingedly coupled to one of said protruding members slidably mounted in a second of said frame support bars;

a securing means for releasably securing said frame support bars to the wheel chair, said securing means comprising:

a pair of elongate members, each of said elongate members having a first end and a second end, each of said first ends of said elongate members being fixedly coupled to one of said frame support members, each of said elongate members being generally located in a central portion of said frame support members, said elongate members generally extending in an opposite direction of said protruding members, each of said second ends of said elongate members being adapted for releasably securing to one of the seat support bars of the wheel chair;

a pair of clamping means, each of said clamping means being fixedly coupled to one of said second ends of said frame support bars, each of said clamping means being adapted for releasably coupling to one of the back rest support bars of the wheel chair;

a fastening means for fastening said cover member to said frame, said fastening means being fixedly coupled to an inside surface of said first, second and third panels, said fastening means being fixedly coupled to each of said covering support bars, said fastening means being generally located on said covering support bars such that said fastening means on said cover member is aligned with said fastening means on said covering support bars, said fastening means being a hook and loop fastening means.

* * * * *